US011490657B2

(12) United States Patent
Liu et al.

(10) Patent No.: US 11,490,657 B2
(45) Date of Patent: Nov. 8, 2022

(54) AXIALLY ROTATING ELECTRIC HEATING DEVICE FOR EXTRACTING TOBACCO

(71) Applicant: HUBEI CHINA TOBACCO INDUSTRY CO., LTD., Hubei (CN)

(72) Inventors: Huachen Liu, Hubei (CN); Yikun Chen, Hubei (CN); Lei Liu, Hubei (CN); Aijun Dong, Hubei (CN); Weichang Ke, Hubei (CN); Bing Liu, Hubei (CN); Chenghao Luo, Hubei (CN)

( * ) Notice: Subject to any disclaimer, the term of this patent is extended or adjusted under 35 U.S.C. 154(b) by 304 days.

(21) Appl. No.: 16/767,013

(22) PCT Filed: Nov. 28, 2018

(86) PCT No.: PCT/CN2018/117787
§ 371 (c)(1),
(2) Date: May 26, 2020

(87) PCT Pub. No.: WO2019/105354
PCT Pub. Date: Jun. 6, 2019

(65) Prior Publication Data

US 2021/0007400 A1 Jan. 14, 2021

(30) Foreign Application Priority Data

Nov. 29, 2017 (CN) ..... 201711224908.0

(51) Int. Cl.
*A24F 13/00* (2006.01)
*A24F 40/46* (2020.01)
(Continued)

(52) U.S. Cl.
CPC ..... *A24F 40/46* (2020.01); *H05B 3/06* (2013.01); *A24F 40/20* (2020.01); *A24F 40/50* (2020.01); *A24F 40/90* (2020.01); *H05B 1/0252* (2013.01)

(58) Field of Classification Search
CPC ..... A24F 47/00
(Continued)

(56) References Cited

U.S. PATENT DOCUMENTS

2003/0056800 A1 3/2003 Lin
2017/0360102 A1* 12/2017 Li ..... A24F 40/465
2019/0320719 A1* 10/2019 Liu ..... A24F 40/46

FOREIGN PATENT DOCUMENTS

CN 2933023 8/2007
CN 204560947 8/2015
(Continued)

OTHER PUBLICATIONS

International Search Report for PCT/CN2018/117787 dated Feb. 13, 2019, 3 pages.
(Continued)

*Primary Examiner* — Phuong K Dinh
(74) *Attorney, Agent, or Firm* — Fresh IP PLC; Clifford D. Hyra; Aubrey Y. Chen

(57) ABSTRACT

An axially rotating electric heating device for extracting tobacco includes a heating cavity outer shell, a heating cavity inner shell, and a heating assembly. The heating assembly includes a heating cavity that accommodates a smoking product and a heating element located in a cigarette heating cavity. The heating cavity is surrounded by the heating cavity inner shell; the heating element is inserted into the smoking product so as to heat the smoking product. The heating cavity inner shell is located at the front end of the heating assembly; the heating cavity outer shell and the heating cavity inner shell form an integral body; the heating cavity may rotate relative to the axis of the heating element to separate the smoking product from the heating element, thereby facilitating the extraction of the smoking product after smoking is finished.

10 Claims, 4 Drawing Sheets

(51) Int. Cl.

| | |
|---|---|
| ***H05B 3/06*** | (2006.01) |
| *A24F 40/90* | (2020.01) |
| *A24F 40/20* | (2020.01) |
| *H05B 1/02* | (2006.01) |
| *A24F 40/50* | (2020.01) |

(58) Field of Classification Search
USPC ..... 131/328–329
See application file for complete search history.

(56) References Cited

FOREIGN PATENT DOCUMENTS

| | | |
|---|---|---|
| CN | 204560948 | 8/2015 |
| CN | 107280074 | 10/2017 |
| CN | 107713009 | 2/2018 |
| CN | 207492067 | 6/2018 |
| JP | 9327283 | 12/1997 |

OTHER PUBLICATIONS

Written Opinion of the ISA for PCT/CN2018/117787 dated Feb. 13, 2019, 4 pages.

* cited by examiner

AXIALLY ROTATING ELECTRIC HEATING DEVICE FOR EXTRACTING TOBACCO

This application is the U.S. national phase of International Application No. PCT/CN2018/117787 filed Nov. 28, 2018 which designated the U.S. and claims priority to CN Patent Application No. 201711224908.0 filed Nov. 29, 2017, the entire contents of each of which are hereby incorporated by reference.

TECHNICAL FIELD

The present disclosure relates to the technical field of novel cigarettes, in particular to an electric heating device that is axially rotatable for extracting tobacco.

BACKGROUND

By the way of heating tobacco with an external heating source at a heating temperature much lower than the burning temperature of the tobacco, the tobacco is heated at a low temperature, thereby significantly reducing the large amount of harmful substances produced by the burning of the tobacco and hence reducing the harm of the second-hand smoke to non-smokers. In the novel cigarettes in which tobacco products are heated by external heating sources, the tobacco products are heated to the atomization temperature to achieve the effect of generating smoke.

There is existing patented technology for electrically heating a low-temperature cigarette, the cigarette is extracted in a manner of longitudinal displacement. The manner of longitudinal displacement has the feature of pushing out the cigarette directly and can match a sheet-shaped electric heater. However, the tobacco cannot be detached completely from the heater by the manner of longitudinal displacement, resulting in a problem of adhesion of the tobacco to the heater, which causes that the tobacco cannot be completely taken out, and the heating chamber is not convenient to clean.

SUMMARY

In order for the separation of the needle-shaped heater from the cigarette, the present disclosure provides an electric heating device that is axially rotatable for extracting tobacco, which can make full use of the advantages of the needle-shaped heater and the axial rotation to solve the problem of the adhesion between the tobacco and the heater in the cigarette, thereby facilitating the removal of the tobacco and the cleaning of the heating chamber.

An electric heating device that is axially rotatable for extracting tobacco includes an outer shell for heating chamber, an inner shell for heating chamber and a heating assembly, where the heating assembly includes a heating chamber configured for receiving a smoking product and a heating element located in the heating chamber, the heating chamber is surrounded and delimited by the inner shell for heating chamber, and the heating element is configured to insert into and heat the smoking product. The inner shell for heating chamber is located at a front end of the heating assembly, the outer shell for heating chamber and the inner shell for heating chamber form an integral body, and the heating chamber is axially rotatable relative to the heating element to detach the smoking product from the heating element, to facilitate the removal of the smoking product after the suction of the smoking product is completed.

Further, a protection cover for heating element is inserted into a cavity between the outer shell for heating chamber and the inner shell for heating chamber, a bottom of the protection cover for heating element is connected with the heating element, and the outer shell for heating chamber is rotatable relative to the protection cover for heating element to drive the heating chamber to rotate.

Further, the outer shell for heating chamber is provided with an inward convex portion, the protection cover for heating element is provided with outward convex portions, two outward convex portions form a sliding groove for receiving the inward convex portion, and the outer shell for heating chamber is rotatable relative to the protection cover for heating element by the sliding of the inward convex portion along the sliding groove, which in turn drives the heating chamber to rotate along an axis of the heating element.

Further, the outer shell for heating chamber is further provided with an inward attachment stub, a fixed part for stopping the inward attachment stub is provided, the protection cover for heating element is further provided with an outward attachment stub, and the inward attachment stub is connected with the outward attachment stub by an elastic piece. After being rotated by an angle, the outer shell for heating chamber returns to its original position under the action of the elastic piece.

Further, an intermediate shaft rotatable around the heating element is disposed at the bottom of the inner shell for heating chamber, and the intermediate shaft is capable of axially rotating, which drives the heating chamber to rotate together.

Further, a protection cover for heating element is inserted into a cavity between the outer shell for heating chamber and the inner shell for heating chamber, a bottom of the protection cover for heating element is connected with the heating element, an inside clamping portion is provided on an inner side of the protection cover for heating element, an outside clamping portion is correspondingly provided on an outer side of the inner shell for heating chamber, the inside clamping portion of the protection cover for heating element and the outside clamping portion of the inner shell for heating chamber are clamped to each other and is rotatable relative to each other, thereby forming a clamping groove structure.

Further, the inside clamping portion of the protection cover for heating element is composed of one or more protrusions or a groove extending across the whole ring area of the protection cover, and the outside clamping portion of the inner shell for heating chamber is composed of one or more protrusions or a groove extending across the whole ring area of the inner shell for heating chamber.

Further, the electric heating device includes a power supply assembly housing and a power supply assembly disposed in the power supply assembly housing.

Further, the power supply assembly comprises a charging module, a battery, a control module and a control button, the control button is connected to the control module and is arranged on a side wall of the power supply assembly housing, the charging module, the battery and the control module are connected to each other, and the battery is charged by a main power supply case or an external power supply through the charging module.

Further, one or more concave grooves are provided on an inner wall of the inner shell for heating chamber.

The beneficial effect of the present disclosure is that the heating chamber is designed as rotatable relative to an axis of the heating element, to effectively separate the cigarette from the needle-shaped heater, and after the cigarette is loosened from the needle-shaped heater, the tobacco segment in the cigarette becomes looser, so that it easier to take out the tobacco without leaving its residual in the heating chamber.

Figure 1:
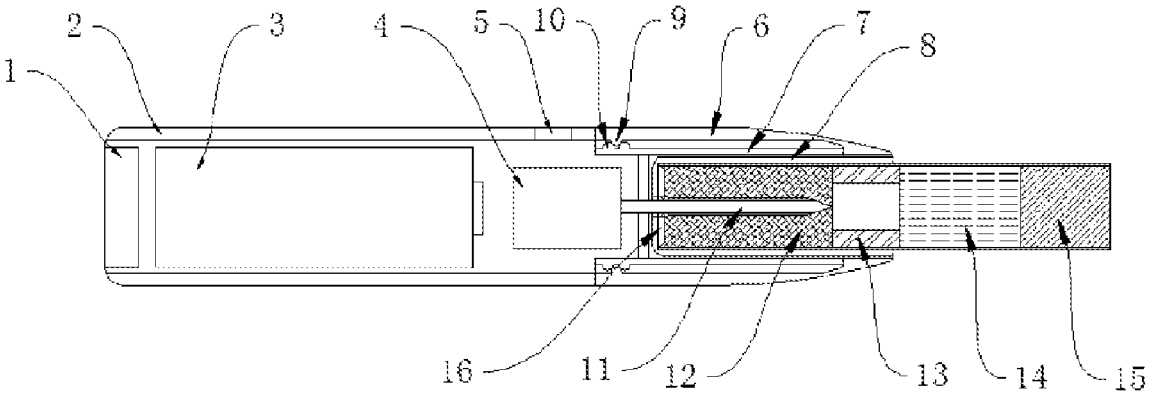
FIG. 1 is a schematic cross-sectional view of a first embodiment of the present invention.

In the drawings: 1—charging module; 2—power supply assembly housing; 3—battery; 4—control module; 5—control button; 6—outer shell for heating chamber; 7—protection cover for heating element; 8—inner shell for heating chamber; 9—inward convex portion of outer shell for heating chamber; 10—outward convex portion of protection cover for heating element; 11—heating component; 12—tobacco segment; 13—hollow cigarette nozzle stick; 14—cooling cigarette nozzle stick; 15—solid cigarette nozzle stick; 16—bottom protrusion of heating chamber; 17—inward attachment stub of outer shell for heating chamber; 18—outward attachment stub of protection cover for heating element; 19—elastic piece; 20—fixed part; 21—intermediate shaft; 22—inside clamping portion of protection cover for heating element; 23—outside clamping portion of inner shell for heating chamber; 24—concave groove; 25—cavity; 26—clamping groove structure; 27—first protrusion; 28—second protrusion.

DETAILED DESCRIPTION

The technical solution of the present disclosure will be described clearly and completely in conjunction with the drawings of the present disclosure.

FIG. 1 is a schematic structural view of a first embodiment of an electric heating device which is axially rotatable for extracting tobacco provided in the present disclosure. The electric heating device includes an outer shell 6 for heating chamber, an inner shell 8 for heating chamber, and a heating assembly. The heating assembly is used to heat a cigarette, which is a smoking product that generates aerosol when being heated rather than burning, and the aerosol generated by the smoking product can be sucked into the lungs of a consumer who sucks the smoking product with the mouth.

The heating assembly includes a heating chamber for receiving a tobacco segment 12 of a cigarette and a heating element located in the heating chamber. The inner shell 8 for heating chamber has a cavity structure with one open end and is located at the front end of the heating assembly, and the shape of the open end may be designed according to the shape of the tobacco product to be heated. The heating chamber is surrounded and delimited by the inner shell 8 for heating chamber. The outer shell 6 for heating chamber and the inner shell 8 for heating chamber form an integral body, and particularly are connected, at an end of the heating chamber for receiving the cigarette, by a certain deformation force or threads, in order to form an axially rotatable integral body. The outer shell 6 for heating chamber and the inner shell 8 for heating chamber are spaced by a distance to form a cavity 25 therebetween, and a protection cover 7 for heating element is inserted into the cavity 25 between the outer shell 6 for heating chamber and the inner shell 8 for heating chamber. A heating component 11 at an end of the heating element is surrounded and protected by the protection cover 7 for heating element, to avoid a damage of the heating component 11 or a damage made by the heating component 11 operating in high temperature to other components. Typically, the protection cover 7 for heating element is longer than the heating component 11. The bottom of the protection cover 7 for heating element is connected to the heating element. There is a gap in the contact area between the inner shell 8 for heating chamber and the outer shell 6 for heating chamber, and the gap facilitates the entry of external air therethrough into the cigarette, so that the entered external air facilitates in taking away the heat transferred from the bottom of the protection cover 7 for heating element, thereby reducing the overall temperature of the heating chamber.

The outer shell 6 for heating chamber is provided with an inward convex portion 9, and the protection cover 7 for heating element is provided with outward convex portions 10, where there are two outward convex portions 10 of the protection cover for heating element, and a sliding groove is formed between these two outward convex portions 10 and used for receive the inward convex portion 9 of the outer shell for heating chamber.

In the normal state, the outer shell 6 for heating chamber is fixed by the inward convex portion 9 of the outer shell for heating chamber being clamped in the sliding groove formed between the outward convex portions 10 of the protection cover 7 for heating element, so that the heating chamber and the heating element are fixed to each other. The heating chamber generally does not rotate relative to the heating element. After the suction of the cigarette is completed, the inward convex portion 9 of the outer shell for heating chamber slides along the sliding groove formed by the outward convex portions 10 of the protection cover for heating element under the action of an external force, so that the outer shell 6 for heating chamber can be rotated relative to the protection cover 7 for heating element, which in turn drives the heating chamber to rotate along the axis of the heating element. During the normal use in suction, it is not necessary to remove the heating chamber from the sliding groove, but only the axial rotation of the outer shell 6 for heating chamber is required. The bottom of the inner shell 8 for heating chamber is provided with a bottom protrusion 16 of the heating chamber, which will be partially embedded in the tobacco segment 12 by the axial rotation of the outer shell 6 for heating chamber. The bottom protrusion 16 of heating chamber may deform the tobacco, ensuring that the cigarette can be rotated along with the heating chamber during the rotation of the heating chamber. During the axial rotation of the heating chamber, with the action of both a friction force between the bottom protrusion 16 of the heating chamber and the cigarette and a friction force between the inner shell 8 for heating chamber and the cigarette, the tobacco segment 12 of the cigarette is separated from the needle-shaped heating component 11. The bottom protrusion 16 of the heating chamber is partially inserted into and deforms the tobacco segment 12, and the tobacco 12 is hardened by heating and baking and thus becomes easier to be moved with the heating chamber, and then a tobacco nozzle stick composed of a hollow cigarette nozzle stick 13, a cooling cigarette nozzle stick 14 and a solid cigarette nozzle stick 15 can be removed, thereby completely removing the cigarette out of the heating chamber.

The electric heating smoking device further includes a power supply assembly housing 2 and a power supply assembly disposed within the power supply assembly housing 2. The outer shell 6 for heating chamber and the power supply assembly housing 2 are detachable from each other, and together form the overall housing of the electric heating smoking device. Both the power supply assembly and the heating assembly are located inside the overall housing, where the power supply assembly is used to provide working power to the heating element of the heating assembly. The power supply assembly includes a charging module 1, a battery 3, a control module 4, and a control button 5. The charging module 1, the battery 3, and the control module 4 are disposed in the power supply assembly housing 2, the control button 5 is connected to the control module 4 and is arranged on the side wall of the power supply assembly housing 2, the charging module 1, the battery 3 and the control module 4 are connected to each other, and the battery 3 may be charged through the charging module 1.

The heating element includes a heating component 11 and a heating medium provided on the heating component 11. A power output end of the control module 4 is connected to the heating component 11, to provide the working power of the battery 3 to the heating medium on the heating component 11, so that the heating medium heats up the smoking products.

The control button 5 is connected to a control end of the control module 4 and is used to control the switching on or off of or the amount of the power that is provided to the heating medium under the control of the control module 4, and hence to control the temperature of the heating component 11. The control button 5 may be designed as for example a switch control button or voltage adjustment button. The battery 3 is a rechargeable battery, and the control module 4 controls the power output of the battery 3 to the heating component 11, so that the power output can be performed according to a variation relationship between the resistance value and the temperature of the heating element, thereby adjusting the temperature of the heating component 11. When the temperature of the heating component 11 is higher than the preset temperature, the power output may be lowered, and when the temperature of the heating component 11 is lower than the preset temperature, the power output may be increased to perform temperature compensation. The working temperature of the heating component 11 may be preset in a range from 280° C. to 400° C.

Figure 2:
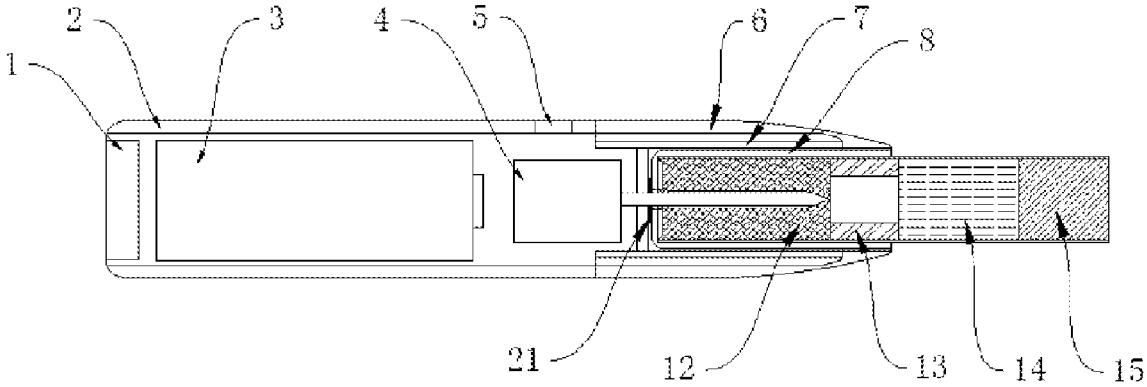
FIG. 2 is a schematic cross-sectional view of a second embodiment of the present invention.

FIG. 2 is a schematic structural view of the second embodiment of the present invention. A rotating component in this embodiment is an intermediate shaft 21, which is an axially rotatable structural component composed of two parts, one of which is connected to the bottom of the inner shell 8 for heating chamber and the other of which is connected to the heating element, and these two parts are connected through a structure such as a bearing, a clamping groove, and a pulley. The intermediate shaft 21 is used to replace the inward convex portion 9 of the outer shell for heating chamber and the sliding groove formed by the outward convex portions 10 of the protection cover for heating element in the first embodiment. The structure using such intermediate shaft 21 can alleviate the problem of the excessive product size caused by the presence of the inward convex portion 9 of the outer shell for heating chamber and the sliding groove formed by the outward convex portions 10 of the protection cover for heating element. The intermediate shaft 21 may be rotated by any angle no more than 360°.

Figure 3:
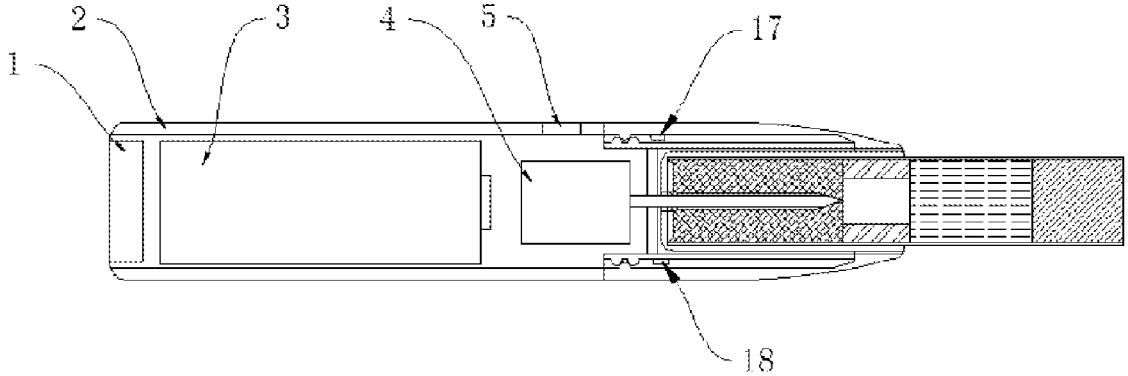
FIG. 3 is a schematic cross-sectional view of a third embodiment of the present invention.
Figure 4:
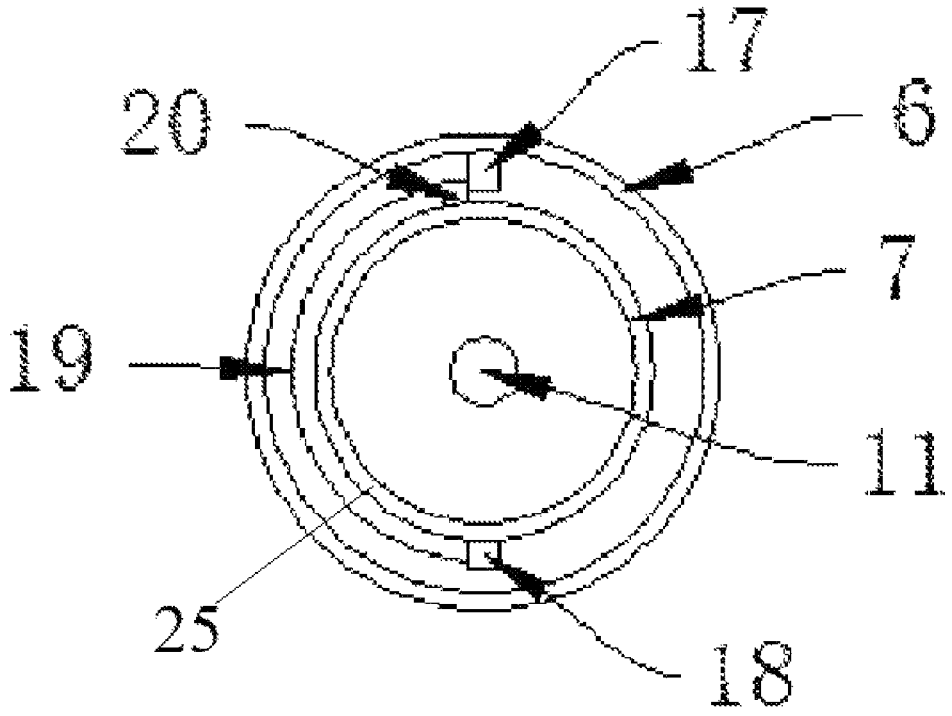
FIG. 4 is a schematic cross-sectional structural view taken at the position of a fixed part in the embodiment shown in FIG. 3.

FIG. 3 is a schematic structural view of the third embodiment of the present invention. Compared with the structure shown in FIG. 1, the structure in the third embodiment further includes four parts, i.e. an inward attachment stub 17 of the outer shell for heating chamber, an outward attachment stub 18 of the protection cover for heating element, an elastic piece 19 and a fixed part 20. The fixed part 20 is used to stop the inward attachment stub 17, and the inward attachment stub 17 and the outward attachment stub 18 are connected through the elastic piece 19 (as shown in FIG. 4). In order to extract the cigarette, the outer shell 6 for heating chamber may be rotated in a direction by an angle no more than 360°, and then can return to its original position under the action of the elastic piece 19 after the external force applied to the outer shell 6 for heating chamber is released. Such a rotation process of the outer shell 6 for heating chamber can cause the tobacco segment 12 to be fully separated from the heating component 11, to facilitate the removal of the tobacco.

Figure 5:
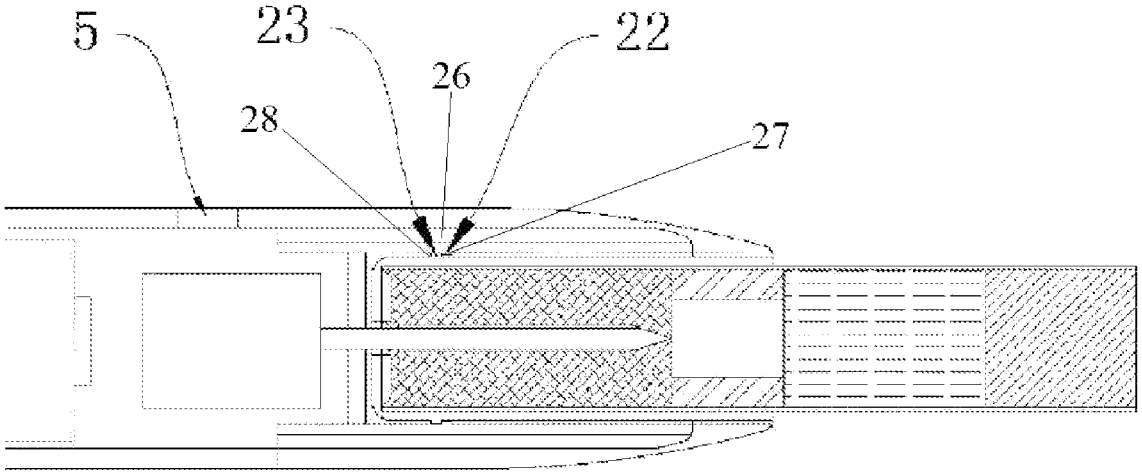
FIG. 5 is a schematic cross-sectional view of the partial structure of a fourth embodiment of the present invention.

FIG. 5 is a schematic structural view of the fourth embodiment of the present invention. In the structure of the fourth embodiment, clamping portions are present on the protection cover 7 for heating element and the inner shell 8 for heating chamber, respectively. Particularly, an inside clamping portion 22 of the protection cover for heating element, which is typically composed of three or more of the first protrusions 27 or a groove extending across the whole ring area of the protection cover 7 for heating element, is located on the inner side of the protection cover 7 for heating element, and an outside clamping portion 23 of the inner shell for heating chamber, which is correspondingly composed of a groove extending across the whole ring area of the inner shell 8 for heating chamber or three or more of the second protrusions 28, is located on the outer side of the inner shell 8 for heating chamber. The inside clamping portion 22 and the outside clamping portion 23 can form a clamping groove structure 26. The inside clamping portion 22 of the protection cover for heating element and the outside clamping portion 23 of the inner shell for heating chamber may be combined in various manners, to ensure that the heating chamber structure composed of the outer shell 6 for heating chamber and the inner shell 8 for heating chamber is rotatable along a rotating area formed by the inside clamping portion 22 of the protection cover for heating element and the outside clamping portion 23 of the inner shell for heating chamber, and will not fall off without the action of an external force.

Figure 6:
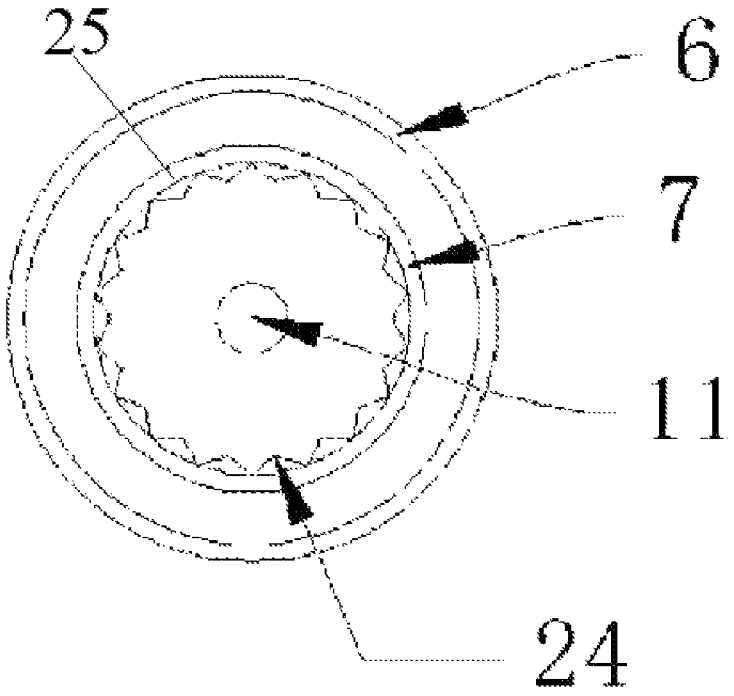
FIG. 6 is a schematic structural view of an inner shell for heating chamber in another embodiment of the present invention.

There exist some frictional forces at areas where the inner shell 6 for heating chamber is in contact with the external surface of the tobacco, so that the rotation of the heating chamber drives the tobacco to rotate through the frictional forces. Alternatively, as shown in FIG. 6, concave grooves 24 are provided on the inner shell 6 for heating chamber to cause certain deformation of the circumference of the tobacco and increase the frictional force between the inner shell 6 for heating chamber and the tobacco.

The above description illustrates merely some specific implementation of the present disclosure, but is not intended to limit the scope of protection of the present invention, and any variation or replacement readily occurring to those skilled in the art within the technical scope disclosed by the present invention should be covered by the protection scope of the present invention. Therefore, the protection scope of the present invention should be subject to the protection scope of the claims.

What is claimed is:

1. An electric heating device that is axially rotatable for extracting tobacco, comprising an outer shell for heating chamber, an inner shell for heating chamber and a heating assembly, wherein the heating assembly includes a heating chamber configured for receiving a smoking product and a heating element located in the heating chamber, the heating chamber is surrounded and delimited by the inner shell for heating chamber, and the heating element is configured to insert into and heat the smoking product, characterized in that, the inner shell for heating chamber is located at a front end of the heating assembly, the outer shell for heating chamber and the inner shell for heating chamber form an integral body, and the heating chamber is axially rotatable relative to the heating element to detach the smoking product from the heating element, to facilitate the removal of the smoking product after the suction of the smoking product is completed.

2. The electric heating device of claim 1, wherein a protection cover for heating element is inserted into a cavity between the outer shell for heating chamber and the inner shell for heating chamber, a bottom of the protection cover for heating element is connected with the heating element, and the outer shell for heating chamber is rotatable relative to the protection cover for heating element to drive the heating chamber to rotate.

3. The electric heating device of claim 2, wherein the outer shell for heating chamber is provided with an inward convex portion, the protection cover for heating element is provided with outward convex portions which form a sliding groove for receiving the inward convex portion, and the outer shell for heating chamber is rotatable relative to the protection cover for heating element by the sliding of the inward convex portion along the sliding groove, which in turn drives the heating chamber to rotate along an axis of the heating element.

4. The electric heating device of claim 3, wherein the outer shell for heating chamber is further provided with an inward attachment stub, a fixed part for stopping the inward attachment stub is provided, the protection cover for heating element is further provided with an outward attachment stub, and the inward attachment stub is connected with the outward attachment stub by an elastic piece, wherein after being rotated, the outer shell for heating chamber returns to its original position under the action of the elastic piece.

5. The electric heating device of claim 1, wherein an intermediate shaft rotatable around the heating element is disposed at the bottom of the inner shell for heating chamber, and the intermediate shaft is capable of axially rotating, which drives the heating chamber to rotate together.

6. The electric heating device of claim 1, wherein a protection cover for heating element is inserted into a cavity between the outer shell for heating chamber and the inner shell for heating chamber, a bottom of the protection cover for heating element is connected with the heating element, an inside clamping portion is provided on an inner side of the protection cover for heating element, an outside clamping portion is correspondingly provided on an outer side of the inner shell for heating chamber, the inside clamping portion of the protection cover for heating element and the outside clamping portion of the inner shell for heating chamber are clamped to each other and is rotatable relative to each other, thereby forming a clamping groove structure.

7. The electric heating device of claim 6, wherein the inside clamping portion of the protection cover for heating element is composed of one or more first protrusions or a groove extending across the whole ring area of the protection cover, and the outside clamping portion of the inner shell for heating chamber is composed of one or more second protrusions or a groove extending across the whole ring area of the inner shell for heating chamber.

8. The electric heating device of claim 1, further comprising a power supply assembly housing and a power supply assembly disposed in the power supply assembly housing.

9. The electric heating device of claim 8, wherein the power supply assembly comprises a charging module, a battery, a control module and a control button, the control button is connected to the control module and is arranged on a side wall of the power supply assembly housing, the charging module, the battery and the control module are connected to each other, and the battery is charged through the charging module.

10. The electric heating device of claim 1, wherein one or more concave grooves are provided on the inner shell for heating chamber.

* * * * *